US007681709B2

(12) United States Patent
Vogt et al.

(10) Patent No.: US 7,681,709 B2
(45) Date of Patent: Mar. 23, 2010

(54) BALUSTRADE FASTENING ARRANGEMENT

(75) Inventors: Andreas Vogt, Berlin (DE); Anne Chen Yangying, Guangzhou (CN); Bernward Engelke, Hildesheim (DE); Ke Ye, Guangzhou (CN)

(73) Assignee: Otis Elevator Company, Farmington, CT (US)

( * ) Notice: Subject to any disclaimer, the term of this patent is extended or adjusted under 35 U.S.C. 154(b) by 25 days.

(21) Appl. No.: 10/544,759

(22) PCT Filed: Feb. 7, 2003

(86) PCT No.: PCT/EP03/01257

§ 371 (c)(1),
(2), (4) Date: Jul. 20, 2006

(87) PCT Pub. No.: WO2004/069723

PCT Pub. Date: Aug. 19, 2004

(65) Prior Publication Data

US 2007/0000754 A1 Jan. 4, 2007

(51) Int. Cl.
*B65G 15/00* (2006.01)

(52) U.S. Cl. ..... 198/335

(58) Field of Classification Search ..... 198/335
See application file for complete search history.

(56) References Cited

U.S. PATENT DOCUMENTS 1,956,155 A * 4/1934 Lindquist et al. ..... 198/335
1,958,155 A * 5/1934 Watkins ..... 137/512.5
2,058,379 A * 10/1936 Handy et al. ..... 198/335
2,193,583 A * 3/1940 Dunlop ..... 198/326
4,690,264 A * 9/1987 Adrian et al. ..... 198/335
5,186,302 A 2/1993 Johnson et al.
5,215,177 A * 6/1993 Johnson et al. ..... 198/335
5,284,237 A * 2/1994 Mello et al. ..... 198/335
5,458,220 A * 10/1995 Nguyen et al. ..... 198/335
6,213,278 B1 4/2001 Tanigawa

FOREIGN PATENT DOCUMENTS

DE 19937618 A1 2/2001
JP 07315747 12/1995
JP 2000211871 8/2000

OTHER PUBLICATIONS

PCT International Search Report for PCT/EP03/01257, dated Feb. 13, 2004.
International Preliminary Examination Report for PCT/EP03/01257, dated Oct. 27, 2004.

* cited by examiner

*Primary Examiner*—Gene Crawford
*Assistant Examiner*—Kavel P Singh
(74) *Attorney, Agent, or Firm*—Carlson, Gaskey & Olds PC

(57) ABSTRACT

A balustrade fastening arrangement for an escalator or passenger conveyor having a moveable skirt panel whereby the fastening arrangement secures an inner decking panel such that it overhangs the moving skirt panel between the skirt panel and the step.

4 Claims, 4 Drawing Sheets

BALUSTRADE FASTENING ARRANGEMENT

FIELD OF THE INVENTION

The present invention is concerned with passenger conveyor systems, such as escalators and moving walkways.

DESCRIPTION OF THE RELATED ART

A typical passenger conveyor, such as an escalator or moving walkway, includes a frame, balustrades with moveable handrails, treadplates or steps, a drive system and a step chain for propelling the treadplates. The frame includes a truss section on both the left and right hand side of the frame. Each truss section has two end portions forming landings, connected by an inclined midsection.

To provide support and safety for the passengers, passenger handrails are provided travelling in the same direction and speed as the steps. A balustrade assembly supports and guides a handrail on each side of the steps.

Each balustrade assembly includes a balustrade panel (which, in many modern escalators, is a glass panel). This extends up from a base to support the handrail. Externally, the base consists of an outer decking, an inner decking and a skirt panel. The outer decking encloses the mechanics on the side of the balustrade panel opposite the moving treadplates or steps. The inner decking encloses the mechanics adjacent the moving steps and also provides a transition section between the balustrade panel and the skirt panel.

The skirt panel is provided to cover some of the elevator system components and to prevent objects being caught between the moving steps and the stationary system structure. This risk is greatest at transition zones such as near landings.

Generally, the skirt panel lies in close proximity to, but out of contact with the moving step plates.

Various steps have been taken to reduce the space between the skirt panel and the step including using special materials and/or surface coatings to produce a low-friction balustrade skirting.

In such standard escalator systems, a fastening arrangement is provided to hold the balustrade and the various panels and decking arrangement in place securely. As far as the inner decking is concerned, this is generally held in place by a balustrade bracket arrangement as will be described in more detail below, and is then fixedly attached to the stationary skirt panel, usually by means of bolts. The skirt panel itself is also fixedly attached in place by bolts, attached to the balustrade brackets.

This arrangement minimises the risk of objects being caught between the escalator mechanism and the steps, due to the presence of the skirt and the fact that the inner decking is fastened to the balustrade at the top and bottom of the inner decking panel.

There have recently been moves to modify the skirt panel so as to eliminate relative motion between various moving parts of the escalator system close to where the passenger stands and to guard against the possibility of objects becoming caught or entrapped at the interface of the moving parts in an escalator system.

One solution to this problem has been to provide a moving skirt panel which moves together with the steps. An example of such a moveable panel is disclosed in WO 02/44071.

Another solution, taught in U.S. Pat. No. 6,213,278 replaces the skirt panel with guard panels attached to the steps. The inner decking panel overhangs the guard panels.

Whilst these moveable skirt or guard panels have advantages in terms of preventing objects becoming caught between the moveable steps and the other parts of the escalator system, because the skirt or guard panel moves together with the steps, it is not possible to attach the stationary balustrade panels, e.g. the inner decking, to the skirt. Thus, it is not possible, as in previous escalator systems, for the inner decking to be attached at both of its ends to the stationary escalator structure for stability.

SUMMARY OF THE INVENTION

Exemplary embodiments of the invention include a balustrade fastening system which allows secure fastening of the inner decking in a case where the elevator system has a moveable skirt.

Exemplary embodiments of the invention include a fastening arrangement which allows the inner decking panel to be securely attached to the balustrade assembly in such a manner that any clearance which would allow objects to become trapped is minimised, even when the escalator has a moving skirt.

Accordingly, the present invention provides, in one aspect, a balustrade fastening arrangement comprising means for supporting a balustrade panel, said means for supporting being attachable to the frame of an escalator or passenger conveyor, said means for supporting further comprising a bracket extending therefrom adapted to be fixedly attached to an inner decking profile extending from the balustrade panel.

According to a second aspect, there is provided a balustrade assembly for an escalator or passenger conveyor, the assembly comprising a balustrade panel, a balustrade holder attaching the balustrade, in use, to a frame of the escalator or passenger conveyor, an inner decking profile extending inwardly and downwardly from the balustrade; an outer decking profile extending outwardly from the balustrade from a point opposite the outward edge of the inner decking profile, characterised in that the balustrade holder is formed with a slot to receive the base portion of the balustrade and means for securing the balustrade in the slot; and further comprising a bracket attached at one end to the balustrade holder and extending to be fixedly attached to the inner decking profile at least one point downwards of the balustrade.

In another aspect, the present invention comprises an escalator or passenger conveyer comprising a truss, a balustrade disposed inward of the truss, a step disposed inward of the balustrade, a balustrade holder attaching the balustrade to the truss, an inner decking profile extending inwardly and downwardly from the balustrade towards the step, an outer decking profile extending outwardly from the balustrade from a point opposite the outward edge of the inner decking profile; a skirt located outwardly out of the step and attached thereto for movement therewith, and a balustrade fastening means comprising a bracket for attachment to said truss and attachment to said inner decking profile, said bracket being configured such that said inner decking profile, when attached to said bracket, overlaps said skirt between said skirt and said step.

BRIEF DESCRIPTION OF THE DRAWINGS

Preferred embodiments of the invention will now be described by way of example only and with reference to the drawings.

DETAILED DESCRIPTION

Figure 1:
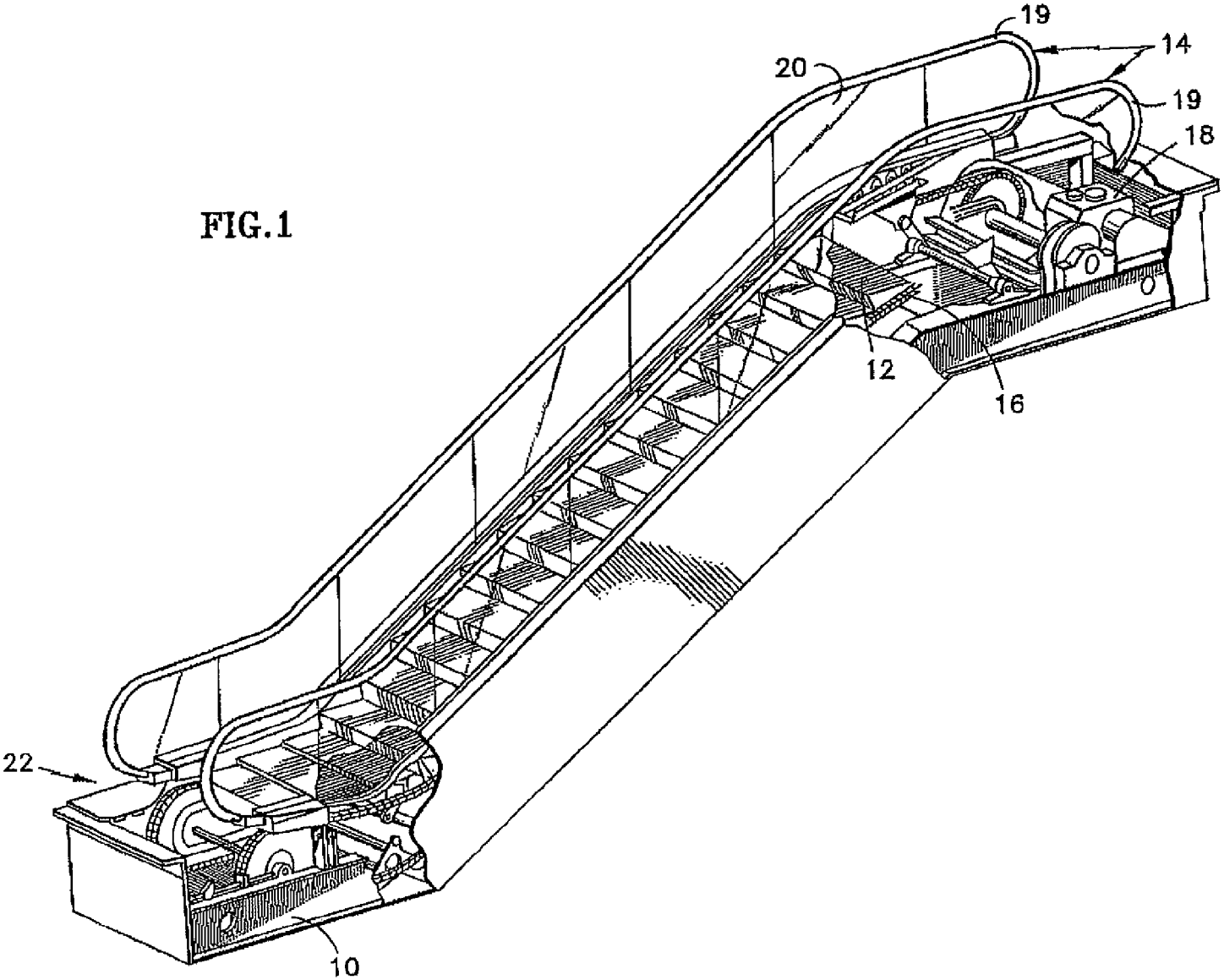
FIG. 1 shows a part-section view of an escalator.
Figure 2:
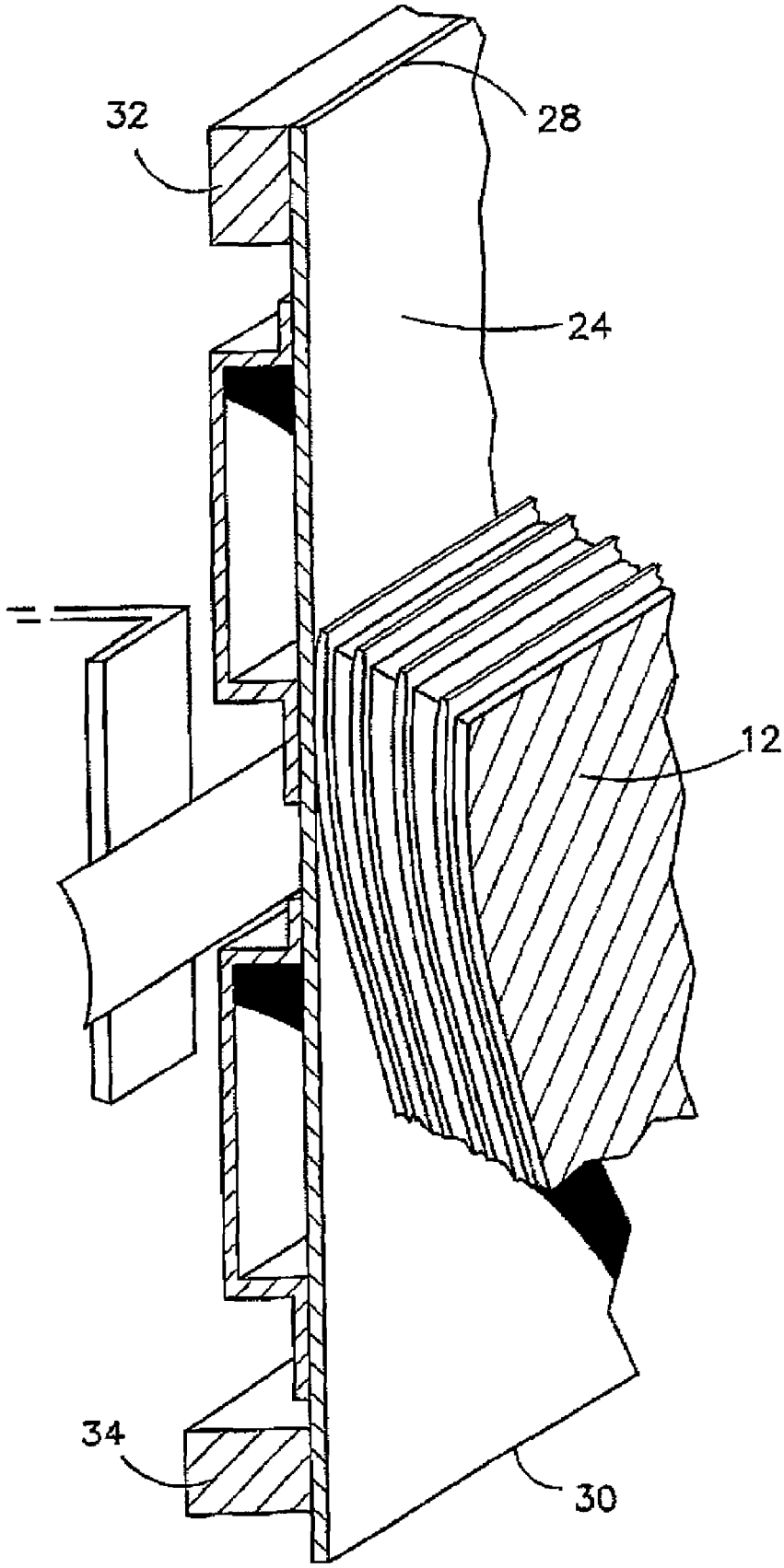
FIG. 2 shows a section through a standard escalator with a fixed skirt.
Figure 3:
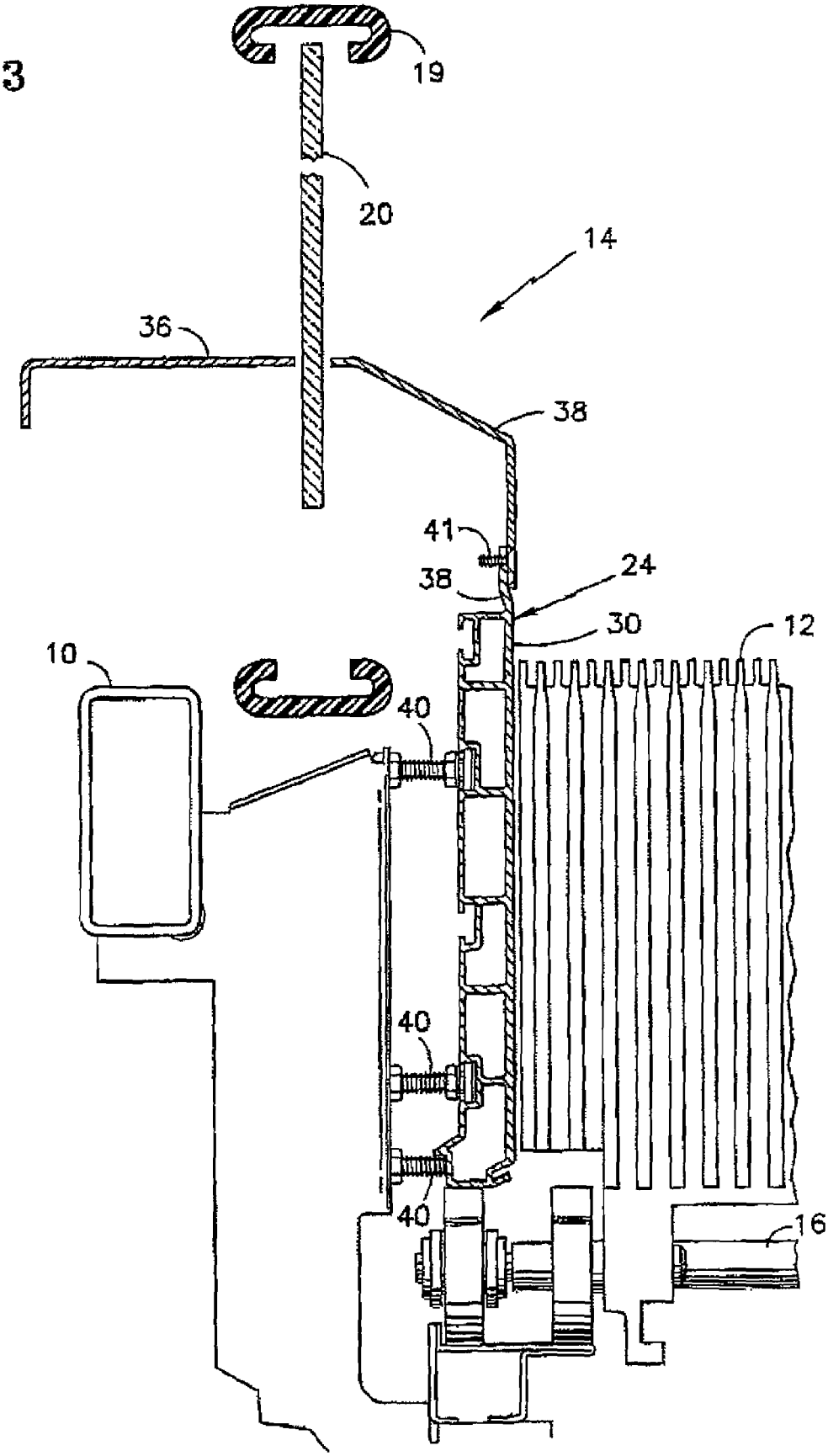
FIG. 3 shows a bracket fastening arrangement for a fixed skirt such as shown in FIG. 2.

FIGS. 1 to 3 will now be described by way of background.

FIG. 1 shows an escalator having a frame or truss 10, a plurality of moving steps 12 and a pair of balustrade assemblies 14. The steps 12 are connected to a step chain 16 which is driven around a continuous path by an electric drive motor 18. On each side of the steps 12, a handrail 19 is driven in the same direction and speed as the steps 12. The handrails 19 enable the passengers (not shown) to steady themselves while riding the escalator.

FIG. 2 shows a balustrade skirt panel 24 in relation to an escalator step 12 which is provided on the outside of the panel. A truss member 26 is disposed behind or on the inside of the skirt panel for supporting various escalator components. The skirt panel is suitably attached at its upper edge 28 and near its bottom edge 30 to stationary escalator components 32 and 34 such as braces, decking profiles etc.

As would be seen, in such prior art systems, the skirt panel 24 is fixedly attached to the elevator truss or frame and is stationary relative to the movement of the steps.

FIG. 3 shows an example of a balustrade fastening arrangement which holds the various balustrade components including the decking profiles etc. in place.

Each balustrade assembly 14 includes a balustrade panel 20 which extends up from a base 22 to support and guide the handrail 19. Externally, the base consists of an outer decking 36, an inner decking 38 and a skirt panel 24. The outer decking 36 encloses the mechanics (not shown) on the side of the balustrade panel 20 opposite the moving steps 12. The inner decking 38 encloses the mechanics (not shown) adjacent the moving steps 12 and provides a transition section between the balustrade panel 20 and the skirt panel 24.

The skirt panel 24 is fixedly attached to the frame or truss 10 e.g. by means of bolts 40. The inner decking 38 is fixedly attached to the fixed skirt panel e.g. by means of a bolt 41.

Although not shown in detail in FIG. 3, the upper end of the inner decking 38 is also fixedly held in place around the balustrade panel 20 by means of a similar bolt arrangement. This is known in the art (see, e.g., U.S. Pat. No. 4,690,264) and will not be described here in further detail.

As mentioned above, a new generation of escalators has now been developed to provide several improvements over existing escalator systems. Some of these improvements are described in, e.g. WO 02/44071. The modification provided in these new systems which is relevant to the present invention is the feature of a moving skirt 42 instead of a fixed skirt.

As discussed above, one important issue presented by passenger conveyer systems such as escalators is the risk of objects being caught between the moving steps and the stationary system structure.

Previous escalator systems have attempted to deal with this problem by provision of a stationary skirt panel as mentioned above and as described, for example, in U.S. Pat. No. 4,669,597. Stationary skirt panels do not, however, eliminate relative motion although they do cover some of the elevator system components. Moveable skirt panels have been proposed, but none have been successfully implemented in the market place. An example is shown in U.S. Pat. No. 4,470,497 which describes a two-piece skirt guard arrangement. This arrangement has not, however, proven successful in the marketplace.

Figure 4:
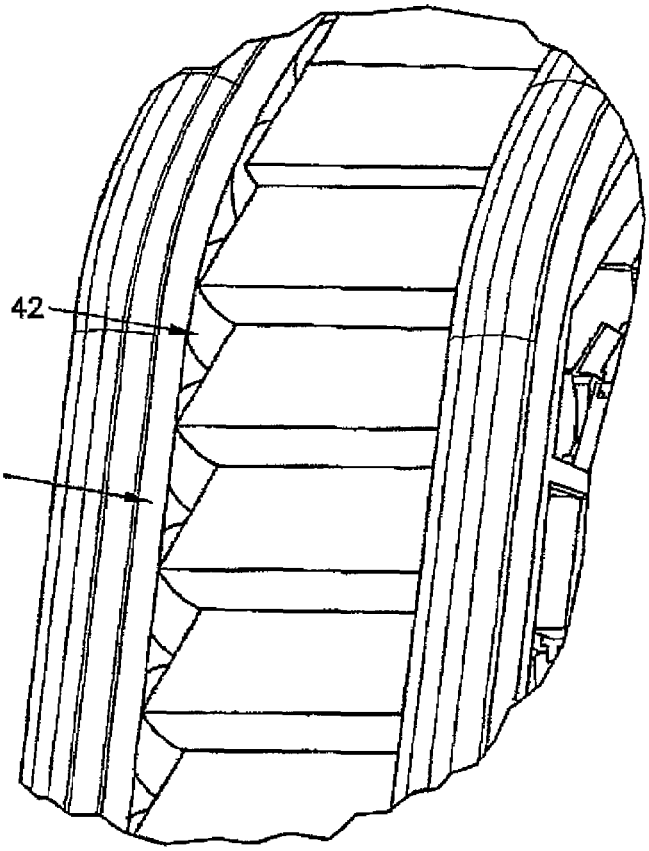
FIG. 4 shows a schematic view of an escalator having a moving skirt into which the present invention can be incorporated and FIG. 5 is a section through a fastening arrangement of the present invention.

The moving skirt arrangement such as described in WO 02/44071 addresses the problem of the prior art by providing a skirt which is formed of components 42 attached to the steps 12 and/or to the drive chain of the escalator steps 12 as shown schematically in FIG. 4 so as to move with the steps. This arrangement reduces the amount of relative motion between parts of the escalator and also provides a reduced clearance between the moving parts. Relative motion between components does not, therefore, pull objects into the space and this relative motion is, in the moving skirt arrangement, actually moved away from the area where the passengers stand.

There is still a need to provide an inner decking to cover up the machine components on the elevator step side of the balustrade. As discussed above, in prior art systems, with a stationary skirt 24, the inner decking 38 has been securely attached to the stationary skirt and, in preferred arrangements, around the balustrade panel itself.

With the moving step arrangement it is not, however, possible to fasten the bottom of the inner decking panel to the skirt panel 42.

It is an aim of the present invention, therefore, to provide a fastening arrangement which allows the inner decking panel to be securely attached to the balustrade assembly in such a manner that any clearance which would allow objects to become trapped is minimised, even when the escalator has a moving skirt.

Figure 5:
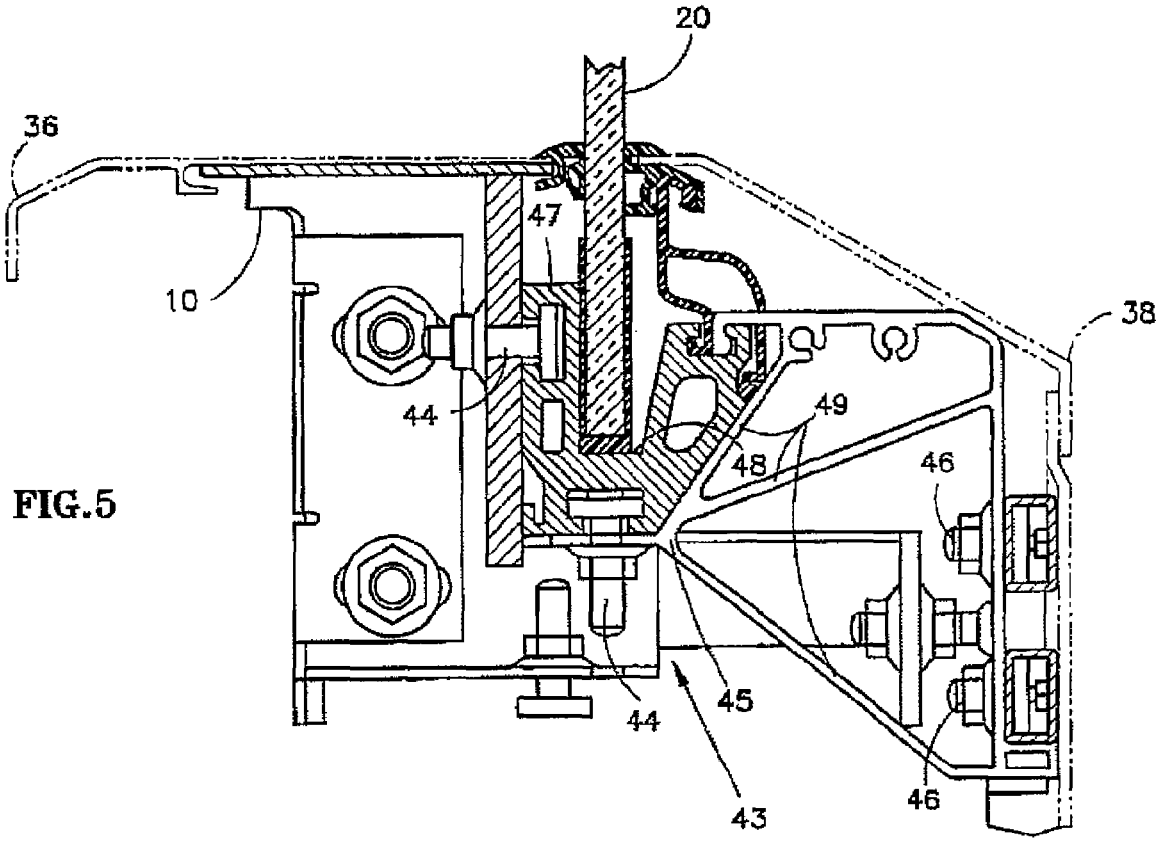

FIG. 5 shows an example of a balustrade fastening arrangement according to the present invention.

The fastening arrangement of the present invention comprises a cantilever bracket structure 43 to hold the inner decking 38 in place.

The bracket structure fits around the bottom of the glass balustrade panel 20, thus also serving to hold the panel in place and is, on the outer side of the panel, fixedly attached to the frame or truss 10 by means of bolts 44. The bracket further comprises a frame structure 45 which extends out to the inner decking 38 and to which the inner decking is fixed again, e.g., by means of bolts 46. The frame structure can also be shaped to extend to both the top bottom and intermediate parts of the inner decking panel for attachment at various points, particularly at both ends.

The dimensions of the bracket structure are such that the structure and the inner decking panel 38 overlap the moving skirt panels 42 at the edges of the steps 12.

Thus, the gap between the step and the inner decking is very small. The bracket structure 43 itself is a monocoque construction. It is possible to fit different shaped inner decking panels, e.g. straight or curved, to this holder.

FIG. 5 shows the fastening arrangement of the present invention in cross-section in relationship to other of the major escalator components, namely a truss 10, a balustrade panel 20, inner and outer decking profiles 38, 36 and the moveable skirt 42. In this description, 'inward' means towards the step, 'outward' means away from the step; 'upward' means toward the top of the escalator and 'downwards' means towards the bottom of the escalator.

The balustrade panel 20 is preferably a sheet of glass having a horizontal thickness and extending vertically-by-longitudinally. The fastening arrangement includes a glassholder 47 with a U-shaped cross section defining a channel 48 into which the balustrade panel fits. The balustrade panel is then clamped in place by a clamp arrangement extending from the U-shaped holder. The holder is bolted to components of the escalator truss.

The holder further comprises a bracket or frame structure 45 which extends along the bottom part of the U-shape and then comprises arms 49 extending upwardly and outwardly, outwardly and downwardly and outwardly towards the inner decking profile 38. This arm arrangement is fixedly attached to the U-shaped holder 47 by means of a bolt to provide a cantilevered bracket 43. The bracket then has an outer frame structure defining an upper horizontal arm and a vertical downwardly extending arm joined by an inclined or knee portion. The dimensions of the various components of the bracket are such that it extends out towards the inner decking profile 38 to support the profile in a position overlapping the moveable skirt 42.

Thus, an inner decking can be provided in combination with a moving skirt panel such that the inner decking overhangs the skirt panel and acts to cover up the moving parts to prevent objects being caught in the escalator, whilst ensuring that the inner panel is securely held in place relative to the balustrade assembly.

The invention claimed is:

1. A balustrade assembly for a passenger conveyor having a truss, the balustrade assembly including:

a balustrade panel;

a balustrade panel holder attached to the truss;

a bracket extending from the balustrade panel holder in a cantilevered manner;

an inner decking profile extending from the balustrade panel, wherein the inner decking profile is fixedly attached to the bracket; and a moving skirt that moves with steps of an associated passenger conveyor, and wherein the inner decking profile extends from the balustrade panel to the moving skirt.

2. The balustrade assembly according to claim 1, wherein the inner decking profile extends to overlap the moving skirt.

3. The balustrade assembly according to claim 1, wherein the inner decking profile is fixedly attached to the bracket at one or more points distal from the balustrade panel.

4. A passenger conveyor including:

moving treadplates;

a moving skirt that moves with the moving treadplates during conveyor operation;

a truss; and a balustrade assembly including a balustrade panel, a balustrade panel holder attached to the truss, a bracket extending from the balustrade panel holder in a cantilevered manner, and an inner decking profile extending from the balustrade panel to a position overlapping the moving skirt, wherein the inner decking profile is fixedly attached to the bracket.

* * * * *